US010525571B2

(12) United States Patent
Hu

(10) Patent No.: US 10,525,571 B2
(45) Date of Patent: Jan. 7, 2020

(54) SCREWDRIVER AND RATCHET MECHANISM THEREOF

(71) Applicant: GONG FONG ENTERPRISE CO., LTD., Tainan (TW)

(72) Inventor: Cheng-Tsan Hu, Tainan (TW)

(73) Assignee: Gong Fong Enterprise Co., Ltd., Tainan (TW)

( * ) Notice: Subject to any disclaimer, the term of this patent is extended or adjusted under 35 U.S.C. 154(b) by 184 days.

(21) Appl. No.: 15/866,754

(22) Filed: Jan. 10, 2018

(65) Prior Publication Data

US 2019/0210199 A1 Jul. 11, 2019

(51) Int. Cl.
*B25B 15/04* (2006.01)
*B25B 23/00* (2006.01)

(52) U.S. Cl.
CPC ..... *B25B 15/04* (2013.01); *B25B 23/0007* (2013.01); *B25B 23/0071* (2013.01)

(58) Field of Classification Search
CPC . B25B 15/04; B25B 23/0007; B25B 23/0071; B25B 13/46
USPC ..... 81/52
See application file for complete search history.

(56) References Cited

U.S. PATENT DOCUMENTS 2,720,296 A * 10/1955 Briglia ..... B25B 13/463 192/43.1
5,974,915 A * 11/1999 Chou ..... B25B 13/463 192/43.2
6,393,949 B1 * 5/2002 Ho ..... B25B 15/04 192/43.1
6,679,363 B1 * 1/2004 Marchant ..... B25B 13/463 192/43.1
7,185,565 B1 * 3/2007 Hu ..... B25B 13/463 81/62
7,287,448 B2 * 10/2007 Hu ..... B25B 13/463 81/58.4
8,522,651 B2 * 9/2013 Xu ..... B25B 15/04 81/60
9,162,348 B2 * 10/2015 Ho ..... B25B 15/04
9,895,793 B2 * 2/2018 Shiao ..... B25B 15/04
(Continued)

FOREIGN PATENT DOCUMENTS

TW M392048 U 11/2010
TW M545023 U 7/2017

*Primary Examiner* — David B. Thomas
(74) *Attorney, Agent, or Firm* — Rosenberg, Klein & Lee

(57) ABSTRACT

A screwdriver and a ratchet mechanism thereof are disclosed. A ratchet mechanism includes: a main body base having blocking portions; a ratchet elastic sheet having abutment portions corresponding to the blocking portions; two blocking sheets retained on the blocking portions and abutted the abutment portions to be positioned between the blocking and abutment portions; a pinion having a gear portion between the blocking sheets to allow the gear portion and the blocking sheets to be adjusted between engagement/disengagement states; a positioning elastic sheet having an operating portion; a ratchet direction adjuster having contact members corresponding to the blocking sheets and an operated portion corresponding to the operating portion. The operating portion operates the operated portion, the contact members contact the blocking sheets and the blocking sheets being operated by the contact members to be in disengagement state with the gear portion to adjust the rotational direction of the gear portion.

7 Claims, 6 Drawing Sheets

(56) References Cited

U.S. PATENT DOCUMENTS

| | | | | |
|---|---|---|---|---|
| 9,914,201 | B2 * | 3/2018 | Chu | B25B 15/04 |
| 2010/0229694 | A1 * | 9/2010 | Chen | B25B 13/463 81/63.1 |
| 2013/0042723 | A1 * | 2/2013 | Wang | B25B 13/463 81/63.1 |

* cited by examiner

SCREWDRIVER AND RATCHET MECHANISM THEREOF

BACKGROUND OF THE INVENTION

1. Technical Field

The technical field relates to a screwdriver and a ratchet mechanism, in particular, to a screwdriver and a ratchet mechanism thereof with reduced component parts, facilitated assembly, low cost and capable of allowing forward/backward rotation works.

2. Description of Related Art

Typically, a conventional screwdriver permits only one working direction, such as the "Torque Screwdriver" of Taiwan Invention Patent No. 1606897, disclosing a screwdriver capable of achieving the effect of aligning the central axis of the driving base with the central axis of the driving head. In addition, Taiwan Utility Model Patent No. M545023 discloses a "Fixed Torque Screwdriver", in which the torque adjustment device is driven to generate a displacement to change the length of a polygonal elastic member in order to change the acting force of the polygonal elastic member acting on the torque transmission device and to change the output torque provided by the driving shaft such that the effect of facilitated operation can be achieved.

However, the prior arts fail to show the effect of allow the screwdrivers to have the working directions of both forward and reverse rotations; therefore, for bolts or nuts having different working directions, one single screwdriver cannot be used conveniently.

Accordingly, the inventor has proposed an "Extendable Precision Ratchet Screwdriver" in Taiwan Patent No. M392048, disclosing the technical feature capable of changing the working directions of a screwdriver.

Nevertheless, the technical feature associated with the change of the working directions of the screwdriver requires a greater number of component parts. Consequently, the cost of such screwdriver is higher and the assembly thereof is relatively complicated.

BRIEF SUMMARY OF THE INVENTION

To overcome the drawbacks of the prior arts, the present invention provides a ratchet mechanism of a screwdriver. The ratchet mechanism of the present invention comprises:

A main body base having a receiving space; an inner wall of the receiving space having a first limiting portion, a second limiting portion and two blocking portions arranged spaced apart from each other; a ratchet elastic sheet arranged on the first limiting portion of the receiving space, and the ratchet elastic sheet having two abutment portions corresponding to the two blocking portions; two blocking sheets arranged inside the receiving space; one side of each blocking sheet retained on one of the blocking portions and another side of each blocking sheet abutted against one of the abutment portions of the ratchet elastic sheet in order to allow the each blocking sheet to be positioned between one of the blocking portions and one of the abutment portions respectively; a pinion penetrating through the main body base and allowing a gear portion of the pinion to be positioned between the two blocking portions such that the gear portion and the two blocking sheets are capable of being adjusted between engagement and disengagement states; a positioning elastic sheet arranged on the second limiting portion of the receiving space; the positioning elastic sheet having an operating portion; a ratchet direction adjuster having two contact members corresponding to one of the blocking sheets; the ratchet direction adjuster having an operated portion corresponding to the operating portion of the positioning elastic sheet; wherein the operating portion is used to operate the operated portion in order to allow one of the contact members to contact with one of the blocking sheets and to allow one of the blocking sheets to be operated by the contact member to form the disengagement state with the gear portion of the pinion such that a rotational direction of the gear portion is adjusted.

Preferably, according to an embodiment of the ratchet mechanism of a screwdriver, the first limiting portion comprises a first recess; two side walls adjacent to the first recess include a bulge formed thereon respectively; the ratchet elastic sheet includes two grooves corresponding to the bulges on the two side walls in order to secure the ratchet elastic sheet onto the first limiting portion.

Preferably, according to an embodiment of the ratchet mechanism of a screwdriver, the second limiting portion comprises a second recess; the second recess includes two blocking walls formed adjacent thereto; the positioning elastic sheet is placed into the second recess and includes two end abutted against the two blocking walls.

Preferably, according to an embodiment of the ratchet mechanism of a screwdriver, the pinon is secured onto the main body base via two C-shape latches.

Preferably, according to an embodiment of the ratchet mechanism of a screwdriver, the ratchet direction adjuster is attached onto a rotating cap.

Preferably, according to an embodiment of the ratchet mechanism of a screwdriver, the operating portion of the positioning elastic sheet is a protruding portion, and the operated portion of the ratchet direction adjuster is formed of three indented portions arranged in parallel.

The present invention further provides a screwdriver, in which a screwdriver workpiece is assembled onto the pinion of the aforementioned ratchet mechanism.

According to the aforementioned technical features, the following technical effects can be achieved:

1. With the use of only one ratchet elastic sheet, it is able to provide elastic force to the blocking sheet of the forward/backward directions such that the technical effect of simplified component and facilitated assembly can be achieved.

2. With the use of only one positioning elastic sheet, it is able to control the blocking sheet of the forward/backward rotations of the screwdriver to selectively retain the gear portion of the pinion such that the technical effect of simplified component parts and facilitated assembly can be achieved.

DETAILED DESCRIPTION OF THE INVENTION

In view of the aforementioned technical features, the main technical effects of the screwdriver and the ratchet mechanism thereof of the present invention are described in detail in the following embodiments.

Figure 1:
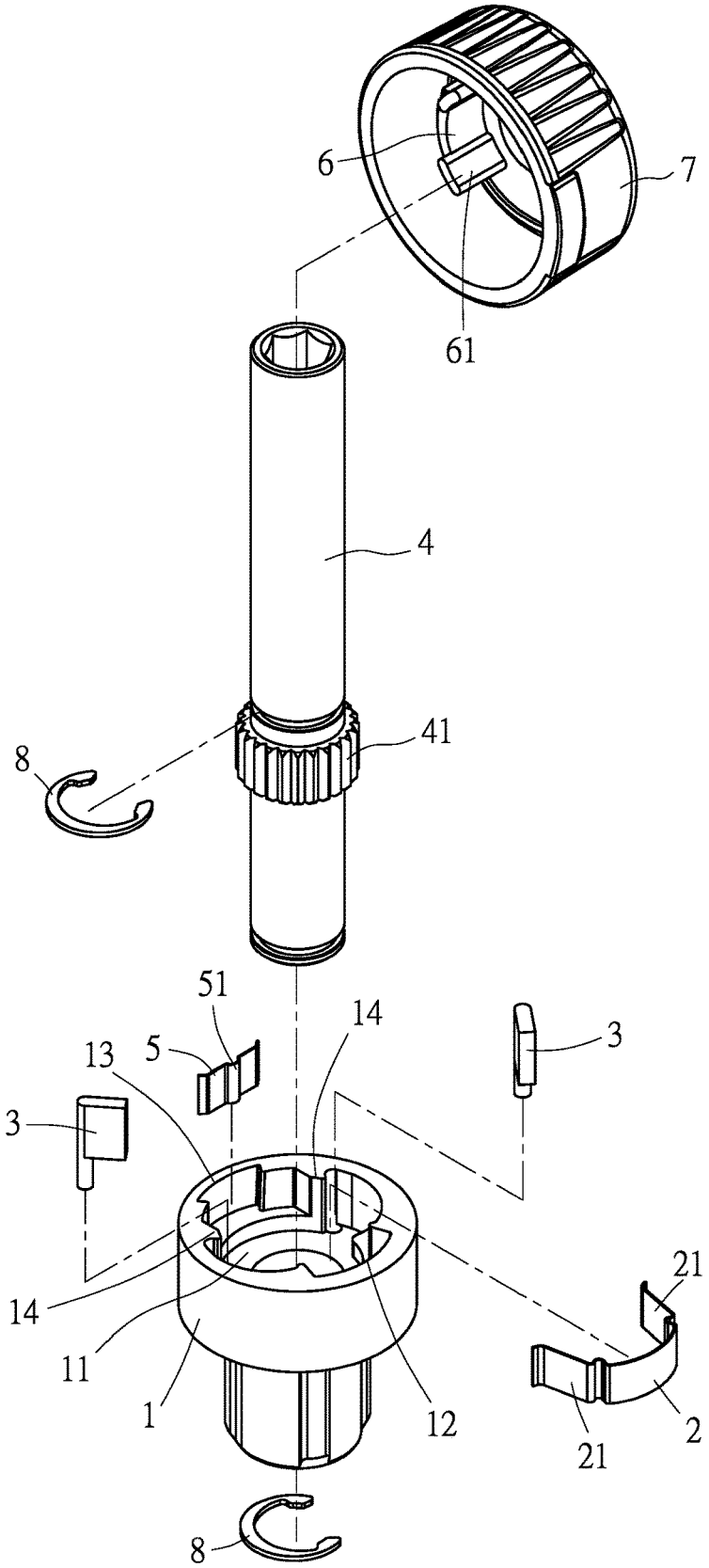
FIG. 1 is a perspective exploded view of the present invention.
Figure 2:
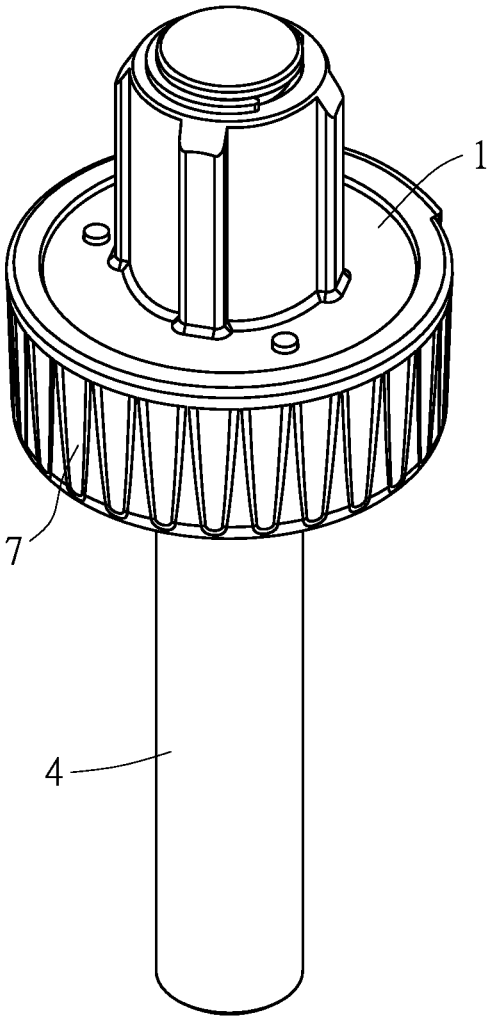
FIG. 2 is a perspective assembly view of the present invention.
Figure 3:
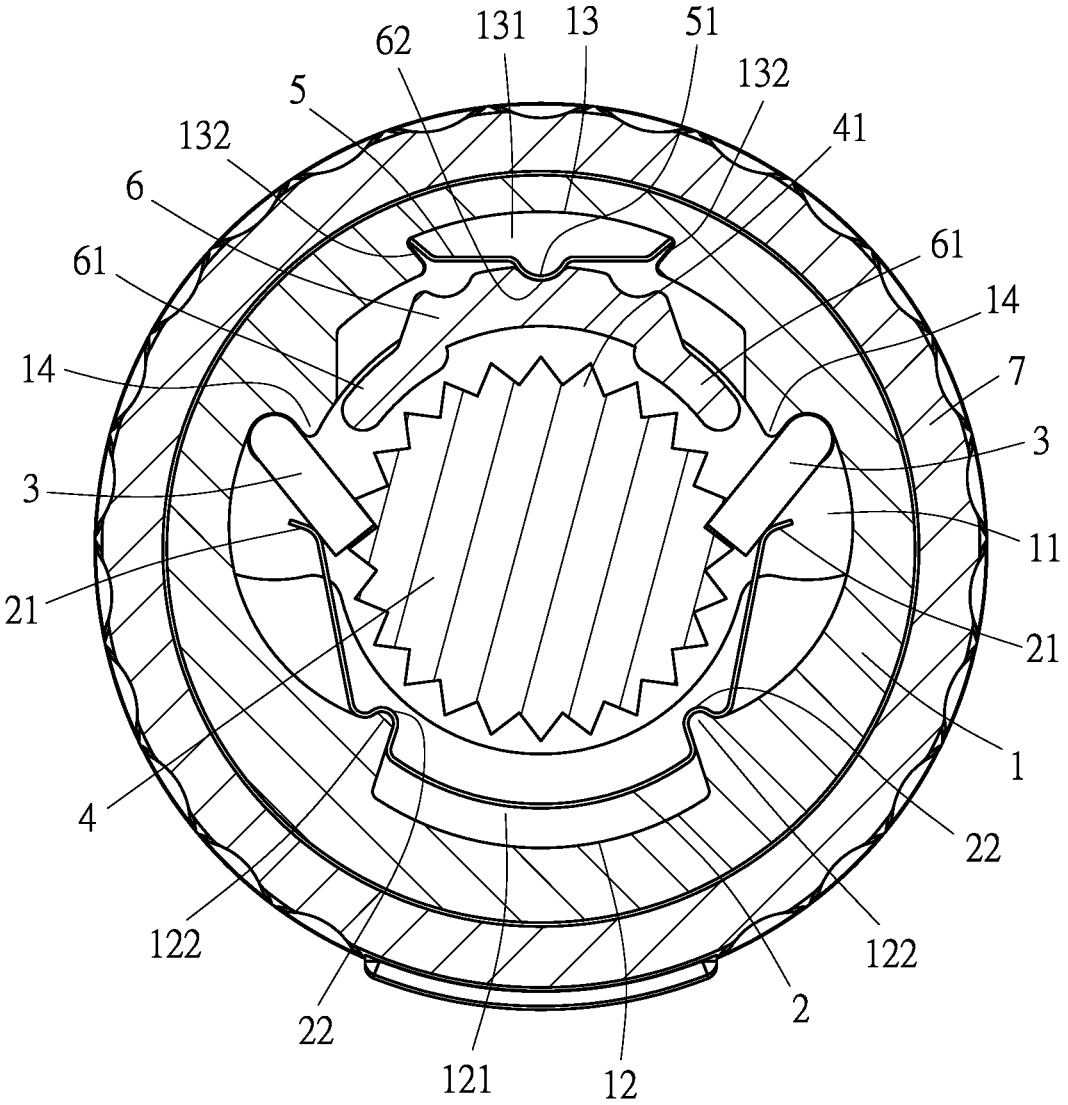
FIG. 3 is a cross sectional view of the present invention.

Please refer to FIG. 1 to FIG. 3. First, a ratchet mechanism according to the present exemplary embodiment is introduced, and it comprises the following.

A main body base (1) includes a receiving space (11), and the inner wall of the receiving space (11) includes a first limiting portion (12), a second limiting portion (13) and two blocking portions (14) arranged spaced apart from each other.

A ratchet elastic sheet (2) is arranged on the first limiting portion (12) of the receiving space (11), and the ratchet elastic sheet (2) includes two abutment portions (21) corresponding to the two blocking portions (14). In this exemplary embodiment, the first limiting portion (12) comprises a first recess (121), two side walls adjacent to the first recess (121) include a bulge (122) formed thereon respectively. The ratchet elastic sheet (2) includes two grooves (22) corresponding to the bulges (122) on the two side walls in order to secure the ratchet elastic sheet (2) onto the first limiting portion (12).

Two blocking sheets (3) are arranged inside the receiving space (11). One side of each blocking sheet (3) is retained on one of the blocking portions (14) and another side of each blocking sheet (3) is abutted against one of the abutment portions (21) of the ratchet elastic sheet (2) in order to allow the each blocking sheet (3) to be positioned between one of the blocking portions (14) and one of the abutment portions (21) respectively;

A pinion (4) penetrates through the main body base (1) and allows a gear portion (41) of the pinion (41) to be positioned between the two blocking portions (3). The pinion (4) is further secured onto the main body base (1) via two C-shape latches (8).

A positioning elastic sheet (5) is arranged on the second limiting portion (13) of the receiving space (11). The second limiting portion (13) comprises a second recess (131), and the second recess (131) includes two blocking walls (132) formed adjacent thereto. The positioning elastic sheet (5) is placed into the second recess (131) and includes two end abutted against the two blocking walls (132). The positioning elastic sheet (5) includes an operating portion (51), and in this exemplary embodiment, the operating portion (51) is a protruding portion.

A ratchet direction adjuster (6) is attached onto a rotating cap (7). The ratchet direction adjuster (6) includes two contact members (61) corresponding to one of the blocking sheets (3). The ratchet direction adjuster (6) includes an operated portion (62) corresponding to the operating portion (51) of the positioning elastic sheet (5). Therefore, the operated portion (62) refers to three indented portions arranged in parallel and formed corresponding to the operating portion (51).

As shown in FIG. 3, normally, when it is not in use, the operating portion (51) being the protruding portion is located at the indented portion at the center location of the operated portion (62), and at this time, the two contact members (61) of the ratchet direction adjuster (6) are not in contact with the two blocking sheets (3) such that the two blocking sheets (3) and the gear portion (41) of the pinion (4) are in an engagement state in order to block the forward/reverse rotational directions of the gear portion (41); therefore, the pinion (4) cannot be rotated.

Figure 4:
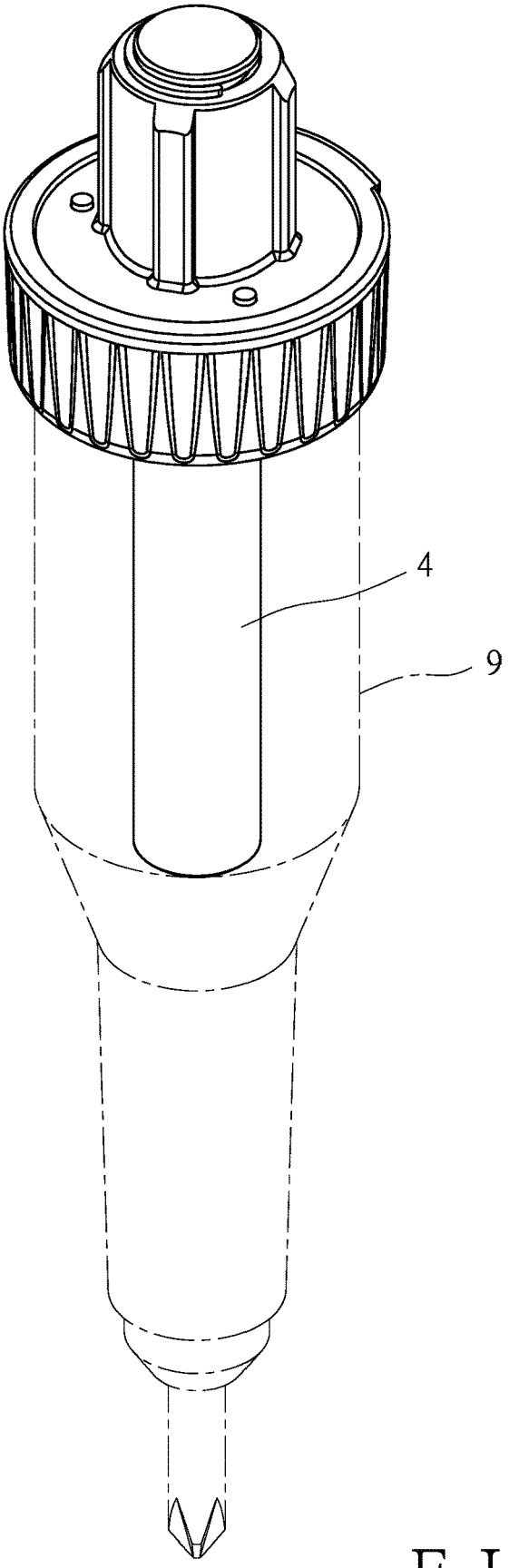
FIG. 4 is an outer appearance view of the screwdriver of the present invention.

As shown in FIG. 4, when a screwdriver workpiece (9) is installed onto the pinion (4), it then becomes a screwdriver of the present invention such that it is able to perform works on a screw bolt or other similar workpiece.

Figure 5:
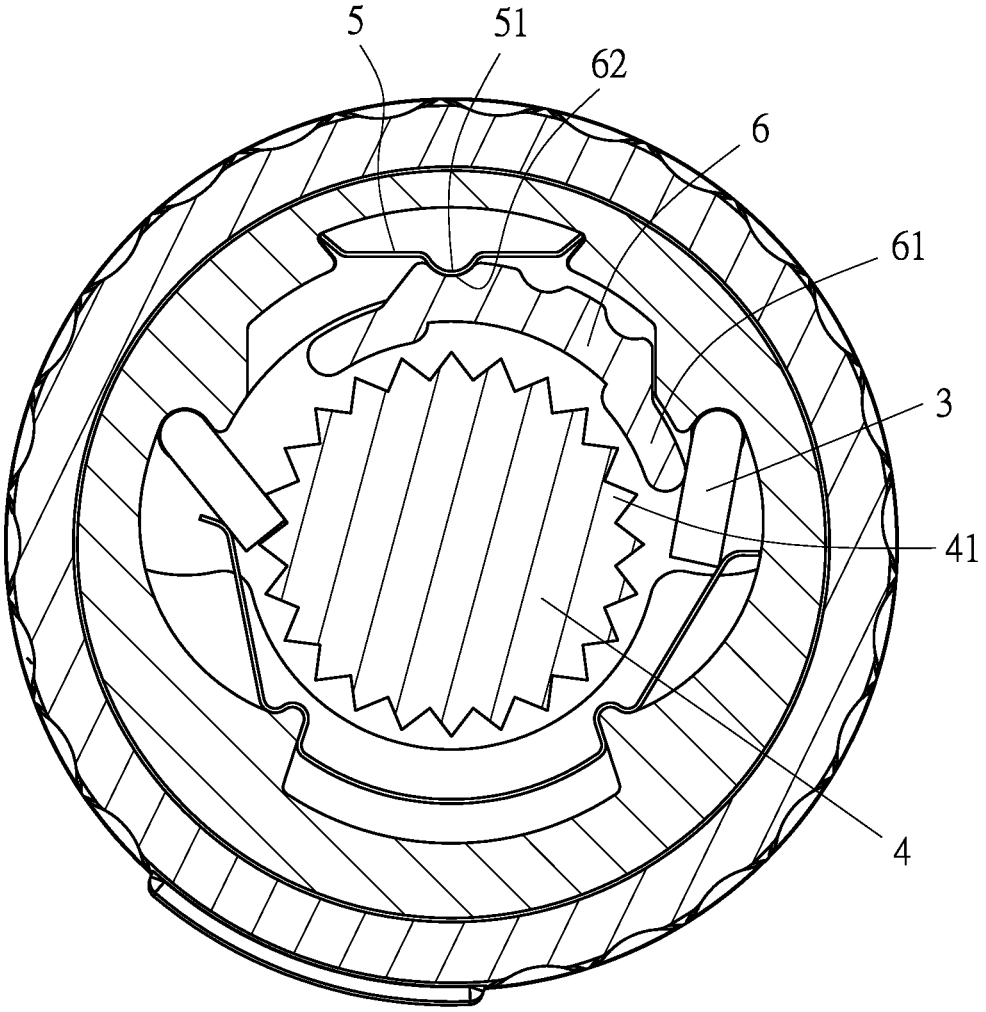
FIG. 5 is a schematic view (1) showing an action of the present invention.
Figure 6:
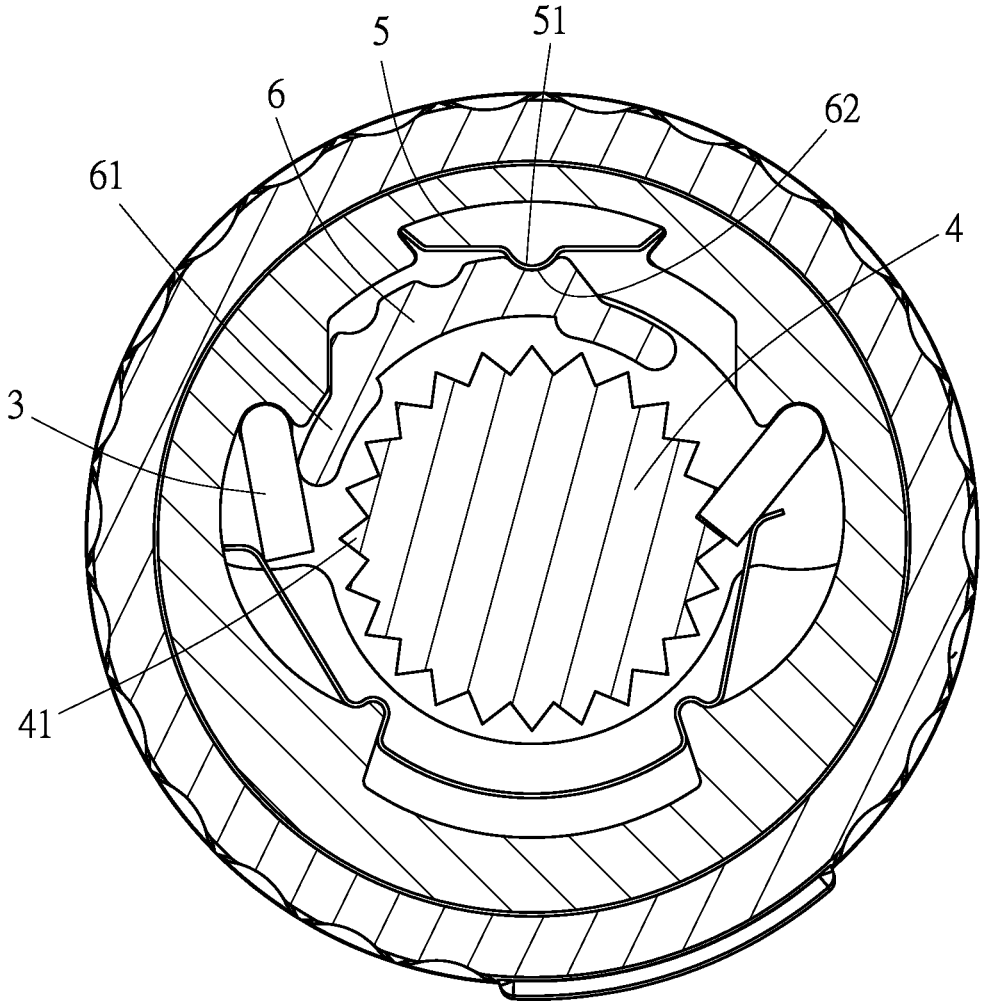
FIG. 6 is a schematic view (2) showing another action of the present invention.

As shown in FIG. 5 and FIG. 6, when there is need to operate a screw bolt or other similar workpiece at work, for the working rotational direction of the screw bolt or other similar workpiece, the operating portion (51) of the positioning elastic sheet (5) can be used to operate the operated portion (62) of the ratchet direction adjuster (6) in order to allow one of the contact members (61) to contact one of the blocking sheets (3), which is able to allow one of the blocking sheets (3) to be operated by the contact member (61) in order to be in a disengagement state with the gear portion (41); therefore, the rotational direction of the pinion (4) can be adjusted. For example, when the operating portion (51) being the protruding portion is operated to position at the indented portion at the left location of the operated portion (62), then the gear portion (41) of the pinion (4) is not limited at the left side; therefore, the gear portion (41) can perform forward rotation toward the clockwise direction. In addition, when the operating portion (51) being the protrusion portion is operated to position at the indented portion at the right location of the operated portion (62), then the gear portion (41) of the pinion (4) is not limited at the right side; therefore, the gear portion (41) can perform reverse rotation toward the counterclockwise direction. Based on the above, the technical effect of forward/reverse rotations of the pinion (4) can be achieved, and the pinion (4) can be used to drive the screwdriver workpiece (9) to perform works on the screw bolt or similar workpiece.

Accordingly, the present invention is able to use only one ratchet elastic sheet to provide elastic force to the blocking sheets for the forward/reverse directions, and it is able to utilize only one positioning elastic sheet to control the blocking sheets for the forward/reverse directions of the screwdriver to selectively block the gear portion of the pinion. Therefore, the present invention is of the technical effects of simplified component parts and facilitated assembly.

In view of the description of the aforementioned embodiments, the operation, usage and the technical effects of the present invention can be understood clearly. However, the aforementioned embodiments are preferred exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A ratchet mechanism of a screwdriver, comprising:

a main body base having a receiving space; an inner wall of the receiving space having a first limiting portion, a second limiting portion and two blocking portions arranged spaced apart from each other;

a ratchet elastic sheet arranged on the first limiting portion of the receiving space, and the ratchet elastic sheet having two abutment portions corresponding to the two blocking portions;

two blocking sheets arranged inside the receiving space; one side of each blocking sheet retained on one of the blocking portions and another side of each blocking sheet abutted against one of the abutment portions of the ratchet elastic sheet in order to allow the each blocking sheet to be positioned between one of the blocking portions and one of the abutment portions respectively;

a pinion penetrating through the main body base and allowing a gear portion of the pinion to be positioned between the two blocking portions such that the gear portion and the two blocking sheets are capable of being adjusted between engagement and disengagement states;

a positioning elastic sheet arranged on the second limiting portion of the receiving space; the positioning elastic sheet having an operating portion;

a ratchet direction adjuster having two contact members corresponding to one of the blocking sheets; the ratchet direction adjuster having an operated portion corresponding to the operating portion of the positioning elastic sheet;

wherein the operating portion is used to operate the operated portion in order to allow one of the contact members to contact with one of the blocking sheets and to allow one of the blocking sheets to be operated by the contact member to form the disengagement state with the gear portion of the pinion such that a rotational direction of the gear portion is adjusted.

2. The ratchet mechanism of a screwdriver according to claim 1, wherein the first limiting portion comprises a first recess; two side walls adjacent to the first recess include a bulge formed thereon respectively; the ratchet elastic sheet includes two grooves corresponding to the bulges on the two side walls in order to secure the ratchet elastic sheet onto the first limiting portion.

3. The ratchet mechanism of a screwdriver according to claim 1, wherein the second limiting portion comprises a second recess; the second recess includes two blocking walls formed adjacent thereto; the positioning elastic sheet is placed into the second recess and includes two end abutted against the two blocking walls.

4. The ratchet mechanism of a screwdriver according to claim 1, wherein the pinon is secured onto the main body base via two C-shape latches.

5. The ratchet mechanism of a screwdriver according to claim 1, wherein the ratchet direction adjuster is attached onto a rotating cap.

6. The ratchet mechanism of a screwdriver according to claim 1, wherein the operating portion of the positioning elastic sheet is a protruding portion, and the operated portion of the ratchet direction adjuster is correspondingly formed of three indented portions arranged in parallel.

7. A screwdriver, comprising:

a main body base having a receiving space; an inner wall of the receiving space having a first limiting portion, a second limiting portion and two blocking portions arranged spaced apart from each other;

a ratchet elastic sheet arranged on the first limiting portion of the receiving space, and the ratchet elastic sheet having two abutment portions corresponding to the two blocking portions;

two blocking sheets arranged inside the receiving space; one side of each blocking sheet retained on one of the blocking portions and another side of each blocking sheet abutted against one of the abutment portions of the ratchet elastic sheet in order to allow the each blocking sheet to be positioned between one of the blocking portions and one of the abutment portions respectively;

a pinion penetrating through the main body base and allowing a gear portion of the pinion to be positioned between the two blocking portions such that the gear portion and the two blocking sheets are capable of being adjusted between engagement and disengagement states;

a positioning elastic sheet arranged on the two limiting portion of the receiving space; the positioning elastic sheet having an operating portion;

a ratchet direction adjuster having two contact members corresponding to one of the blocking sheets; the ratchet direction adjuster having an operated portion corresponding to the operating portion of the positioning elastic sheet;

wherein the operating portion is used to operate the operated portion in order to allow one of the contact members to contact with one of the blocking sheets and to allow one of the blocking sheets to be operated by the contact member to form the disengagement state with the gear portion of the pinion in such that a rotational direction of the gear portion is adjusted; and a screwdriver workpiece attached onto the pinion.

* * * * *